US010267321B2

(12) United States Patent
Nonaka et al.

(10) Patent No.: US 10,267,321 B2
(45) Date of Patent: Apr. 23, 2019

(54) STATOR DISK AND VACUUM PUMP

(71) Applicant: Edwards Japan Limited, Yachiyo-shi, Chiba (JP)

(72) Inventors: Manabu Nonaka, Yachiyo (JP); Takashi Kabasawa, Yachiyo (JP)

(73) Assignee: Edwards Japan Limited, Chiba (JP)

( * ) Notice: Subject to any disclaimer, the term of this patent is extended or adjusted under 35 U.S.C. 154(b) by 471 days.

(21) Appl. No.: 14/787,377

(22) PCT Filed: Mar. 7, 2014

(86) PCT No.: PCT/JP2014/056052

§ 371 (c)(1),
(2) Date: Oct. 27, 2015

(87) PCT Pub. No.: WO2014/181575

PCT Pub. Date: Nov. 13, 2014

(65) Prior Publication Data

US 2016/0069350 A1 Mar. 10, 2016

(30) Foreign Application Priority Data

May 9, 2013 (JP) ..... 2013-098990

(51) Int. Cl.
*F04D 17/16* (2006.01)
*F04D 29/44* (2006.01)
(Continued)

(52) U.S. Cl.
CPC ..... *F04D 17/168* (2013.01); *F04D 29/30* (2013.01); *F04D 29/444* (2013.01); *F04D 19/046* (2013.01)

(58) Field of Classification Search
CPC ..... F04D 17/168; F04D 29/30; F04D 29/444; F04D 19/046; F04D 19/04; F04D 19/042
See application file for complete search history.

(56) References Cited

U.S. PATENT DOCUMENTS 6,343,910 B1 * 2/2002 Kawasaki ..... F04D 19/046 415/90
6,394,747 B1 * 5/2002 Hablanian ..... F04D 17/168 415/55.1
(Continued)

FOREIGN PATENT DOCUMENTS

JP S60204997 A 10/1985
JP S61226596 A 10/1986
(Continued)

OTHER PUBLICATIONS

PCT International Search Report dated May 20, 2014 for corresponding PCT Application No. PCT/JP2014/056052.

*Primary Examiner* — Eldon T Brockman
(74) *Attorney, Agent, or Firm* — Westman, Champlin & Koehler, P.A.; Theodore M. Magee

(57) ABSTRACT

A stator disk includes a connection hole for improving exhaust efficiency in a vacuum pump including a Seigbahn type molecular pump portion, and a vacuum pump including the stator disk. The vacuum pump according to an embodiment includes a Seigbahn type molecular pump portion and includes, in a stator disk disposed therein, a connection hole that connects an upper space (an inlet port side region, an upstream side region) with a lower space (an outlet port side region, a downstream side region) in the axial direction of the stator disk.

20 Claims, 16 Drawing Sheets

(51) Int. Cl.
*F04D 29/30* (2006.01)
*F04D 19/04* (2006.01)

(56) References Cited

U.S. PATENT DOCUMENTS

| | | | | |
|---|---|---|---|---|
| 8,070,419 | B2 * | 12/2011 | Helmer | F04D 19/04 415/90 |
| 9,217,439 | B2 * | 12/2015 | Kabasawa | F04D 19/042 |
| 2010/0158672 | A1 * | 6/2010 | Helmer | F04D 17/168 415/120 |
| 2013/0058782 | A1 * | 3/2013 | Kabasawa | F04D 19/042 415/220 |

FOREIGN PATENT DOCUMENTS

| | | | |
|---|---|---|---|
| JP | H0299290 | | 8/1990 |
| JP | 2501275 | | 3/1996 |
| JP | H08511071 | | 11/1996 |
| JP | 2002031081 | A | 1/2002 |
| JP | 2005030209 | A | 2/2005 |
| JP | 2013508595 | A | 3/2013 |

* cited by examiner

STATOR DISK AND VACUUM PUMP

CROSS-REFERENCE TO RELATED APPLICATION

This Application is a Section 371 National Stage Application of International Application No. PCT/JP2014/056052, filed Mar. 7, 2014, which is incorporated by reference in its entirety and published as WO 2014/181575 A1 on Nov. 13, 2014 and which claims priority of Japanese Application No. 2013-098990, filed May 9, 2013.

FIELD OF THE INVENTION

The present invention relates to a stator disk and a vacuum pump. More specifically, the present invention relates to a stator disk including connection holes for improving exhaust efficiency and a vacuum pump including the stator disk.

BACKGROUND

A vacuum pump includes a casing that forms a casing including an inlet port and an outlet port, and a structure for causing the vacuum pump to exhibit an exhaust function is housed in the casing. The structure for causing the vacuum pump to exhibit the exhaust function is roughly configured from a rotatably axially supported rotor portion and a stator portion fixed to the casing.

A motor for rotating a rotating shaft at high speed is provided. When the rotating shaft rotates at high speed according to the function of the motor, gas is sucked from the inlet port and discharged from the outlet port according to interaction of a rotor blade (a rotating disk) and a stator blade (a stator disk).

Among vacuum pumps, a Seigbahn type molecule pump having a Seigbahn type configuration is a vacuum pump including a rotating disk (a rotating disc) and a stator disk set to have a gap (a clearance) from the rotating disk in the axial direction. A spiral groove (also referred to as helical groove or swirl-like groove) channel is engraved on a gap-opposed surface of at least one of the rotating disk and the stator disk. The vacuum pump gives, with the rotating disk, a momentum in a rotating disk tangential direction (i.e., a tangential direction of a rotating direction of the rotating disk) to gas molecules diffusing and entering the spiral groove channel to give dominant directivity from an inlet port to an outlet port and perform exhaust.

To industrially use the Seigbahn type molecular pump or a vacuum pomp including a Seigbahn type molecular pump portion, rotating disks and stator disks are formed in multiple stages because a compression ratio is insufficient when the stage of the rotating disk and the stator disk is single.

However, the Seigbahn type molecular pump is a radial flow pump element. Therefore, in order to achieve the multiple stages, a configuration is necessary in which a channel is turned back at outer circumferential end portions and inner circumferential end portions of the rotating disks and the stator disks from the inlet port to the outlet port (i.e., in the axial direction of the vacuum pump) to, for example, exhaust gas from an outer circumferential portion to an inner circumferential portion, thereafter exhaust the gas from the inner circumferential portion to the outer circumferential portion, and exhaust the gas from the outer circumferential portion to the inner circumferential portion again.

Japanese Patent Application Laid-Open No. S60-204997 describes a technique for, in a vacuum pump, providing a turbo molecular pump portion, a helical groove pump portion, and a centrifugal pump portion in a pump housing.

Japanese Utility Model Registration No. 2501275 describes a technique for, in a Seigbahn type molecular pump, providing spiral grooves in different directions on opposed surfaces of rotating disks and stationary disks.

A flow of gas molecules (gas) in the configuration of the related art is as explained below.

Gas molecules transferred to an inner diameter portion in an upstream Seigbahn type molecular pump portion are discharged to a space formed between a rotating cylinder and the stator disk. Subsequently, the gas molecules are sucked by an inner diameter portion of a downstream Seigbahn type molecular pump portion opened in the space and transferred to an outer diameter portion of the downstream Seigbahn type molecular pump portion. When the rotating disks and the stator disks are formed in the multiple stages, this flow is repeated in each of the stages.

However, the space (i.e., the space formed between the rotating cylinder and the stator disk) does not have exhaust action. Therefore, a momentum in an exhaust direction given to the gas molecules in the upstream Seigbahn type molecular pump portion is lost when the gas molecules reach the space.

FIG. 12 is a diagram for explaining a conventional Seigbahn type molecular pump 1000 and is a diagram showing a schematic configuration example of the conventional Seigbahn type molecular pump 1000. Arrows indicate a flow of gas molecules.

FIG. 13 is a diagram for explaining a stator disk 5000 disposed in the conventional Seigbahn type molecular pump 1000 and is a sectional view of the stator disk 5000 viewed from an inlet port 4 side. Arrows inside the stator disk 5000 indicate a flow of gas molecules. An arrow outside the stator disk 5000 indicates a rotating direction of a rotating disk not shown in the figure.

Note that, in the following explanation, the inlet port 4 side of one (one stage of) stator disk 5000 is referred to as Seigbahn type molecular pump upstream region and an outlet port 6 side is referred to as Seigbahn type molecular pump downstream region.

As explained above, in the Seigbahn type molecular pump 1000, even if a dominant momentum toward the outlet port 6 is given to the gas molecules, since an inner turning-back channel "a" (i.e., a space formed between a rotating cylinder 10 and the stator disk 5000), which is a channel of the gas molecules, is a "connection" space not having exhaust action, the given momentum is lost. Therefore, since the exhaust action is interrupted in the inner turning-back channel "a", the compressed gas molecules are released every time the gas molecules pass the inner turning-back channel "a". As a result, satisfactory exhaust efficiency is not obtained in the conventional Seigbahn type molecular pump 1000.

If the channel cross-sectional area of the inner turning-back channel "a" is reduced (i.e., a gap formed by the outer diameter of the rotating cylinder 10 and the inner diameter of the stator disk 5000 is narrowed) by, for example, reducing dimensions, the gas molecules are held up in the inner turning-back channel "a" and a channel pressure of the inner turning-back channel "a", which is an outlet (a turning-back point from an upstream region to a downstream region) of the Seigbahn type molecular pump upstream region, rises. As a result, a pressure loss occurs and the exhaust efficiency of the entire vacuum pump (Seigbahn type molecular pump 1000) is deteriorated.

In order to prevent the deterioration in the exhaust efficiency, conventionally, as shown in FIG. 12, the channel cross-sectional area and the conduit width of the inner turning-back channel "a" need to be secured sufficiently larger than the cross-sectional area and the conduit width of a conduit (which is a gap formed by opposed surfaces of the rotating cylinder 10 and the stator disk 5000 and is a tubular channel through which the gas molecules pass) in the Seigbahn type molecular pump portion.

However, if the dimensions of the channel of the inner turning-back channel "a" are set large, the inner diameter side is limited by the dimensions of, for example, a radial direction magnetic bearing device 30 that supports a rotating portion. On the other hand, if the diameter of the stator disk 5000 on the outer diameter side is increased, the radial direction dimension of the Seigbahn type molecular pump portion decreases and the channel is narrowed. As a result, compression performance per one stage is not sufficiently obtained.

In order to obtain a predetermined compression ratio using the related art, it is necessary to increase the number of stages of the Seigbahn type molecular pump portion. However, when the number of stages is increased, material expenses and machining expenses of the rotating disk 9 and the stator disk 5000 increase. Further, the mass inertia moments of the rotating disk 9 rotating at high speed increase, and the capacity of the magnetic bearing device supporting the rotating disk 9 needs to be increased correspondingly. As a result, costs of components configuring the vacuum pump increase.

The discussion above is merely provided for general background information and is not intended to be used as an aid in determining the scope of the claimed subject matter. The claimed subject matter is not limited to implementations that solve any or all disadvantages noted in the background.

SUMMARY

Therefore, it is an object of the present invention to provide a stator disk including a connection hole for improving exhaust efficiency and a vacuum pump including the stator disk.

In order to attain the object, according to an aspect of the present invention, there is provided a stator disk that is used in a first gas transfer mechanism for transferring gas from an inlet port side to an outlet port side and forms a spiral groove exhaust portion by interaction with a rotating disk. A spiral groove including a root portion and a ridge portion is formed in at least a part of opposed surfaces of the stator disk and the rotating disk. A connection hole penetrating from the inlet port side to the outlet port side is provided in an inner circumference side portion of the stator disk.

In the stator disk according to the aspect, the connection hole may be a connection hole that connects, among the root portions, the root portion formed on a surface of the stator disk on the inlet port side with the root portion formed on a surface of the stator disk on the outlet port side.

In the stator disk according to the aspect, an opening of the connection hole may be formed in, among the root portions, the root portion of either a surface of the stator disk on the inlet port side or a surface of the stator disk on the outlet port side.

In the stator disk according to the aspect, an opening portion of the connection hole may be formed across, among the root portions, a plurality of the root portions at an end of the outlet port side on a surface of the stator disk on the inlet port side, or a plurality of the root portions at an end of the inlet port side on a surface of the stator disk on the outlet port side.

In the stator disk according to the aspect, the connection hole may be a connection hole formed to open to a gap formed by a rotating body cylinder portion and an inner circumferential portion of the stator disk that are used in the first gas transfer mechanism.

In the stator disk according to the aspect, the connection hole may be a connection hole that penetrates from a region on a rotating direction side of the rotating disk in the root portion at an end of the outlet port side on a surface of the stator disk on the inlet port side, to a region on the opposite side to the rotating direction side of the rotating disk in the root portion at an end of the inlet port side on a surface of the stator disk on the outlet port side.

In the stator disk according to the aspect, the spiral groove may have a tangential angle larger on an inner diameter side than on an outer diameter side.

In the stator disk according to the aspect, the spiral groove may have a width of the ridge portion smaller on an inner diameter side than on an outer diameter side.

According to another aspect of the present invention, there is provided a vacuum pump including: a casing in which an inlet port and an outlet port are formed; a rotating shaft included in the casing and rotatably supported; the stator disk according to the aspect; the rotating disks in multiple stages disposed in the rotating shaft; and the first gas transfer mechanism, which is a Seigbahn type molecular pump portion that transfers gas sucked from the inlet port side to the outlet port side by interaction of the rotating disk and the stator disk.

The vacuum pump according to the other aspect may further include a rotating body cylinder portion disposed in the rotating shaft. A width of a gap formed by the rotating body cylinder portion and the stator disk excluding the connection hole may be smaller than a depth of an exhaust groove channel formed by the stator disk and the rotating disk on the inlet port side.

The vacuum pump according to the other aspect may further include a rotating body cylinder portion disposed in the rotating shaft. The cross-sectional area of a gap formed by the rotating body cylinder portion and the stator disk excluding the connection hole may be smaller than the cross-sectional area of an exhaust groove channel formed by the stator disk and the rotating disk on the inlet port side.

The vacuum pump according to the other aspect may be a complex type turbo molecular pump further including: a rotor blade; a stator blade; and a second gas transfer mechanism, which is a turbo molecular pump portion that transfers gas sucked from the inlet port side to the outlet port side by interaction of the rotor blade and the stator blade.

The vacuum pump according to the other aspect may be a complex type turbo molecular pump including a third gas transfer mechanism, which is a screw groove type pump portion that includes a screw groove in at least a part of opposed surfaces of a rotating component and a stator component, and that transfers gas sucked from the inlet port side to the outlet port side.

According to the present invention, it is possible to provide a stator disk including a connection hole for improving exhaust efficiency and a vacuum pump including the stator disk.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

DETAILED DESCRIPTION (i) Overview of an Embodiment

A vacuum pump according to an embodiment of the present invention includes a Seigbahn type molecular pump portion and includes, in a stator disk disposed therein, a connection hole that connects an upper space (an inlet port side region, an upstream side region) with a lower space (an outlet port side region, a downstream side region) in the axial direction of the stator disk.

(ii) Details of the Embodiment

A preferred embodiment of the present invention is explained in detail with reference to FIGS. 1 to 11.

In this embodiment, a Seigbahn type molecular pump is explained as an example of the vacuum pump.

Note that, in this embodiment, a direction perpendicular to the diameter direction of a rotating disk is an axial direction.

In the following explanation, an inlet port side of one (one stage of) stator disk is referred to as Seigbahn type molecular pump upstream region and an outlet port side of the stator disk is referred to as Seigbahn type molecular pump downstream region.

First, the configuration of a Seigbahn type for turning back and exhausting gas to exhaust the gas in the Seigbahn type molecular pump upstream region from an outer diameter side to an inner diameter side and exhaust the gas in the Seigbahn type molecular pump downstream region from the inner diameter side to the outer diameter side is explained.

(ii-1) Configuration

Figure 1:
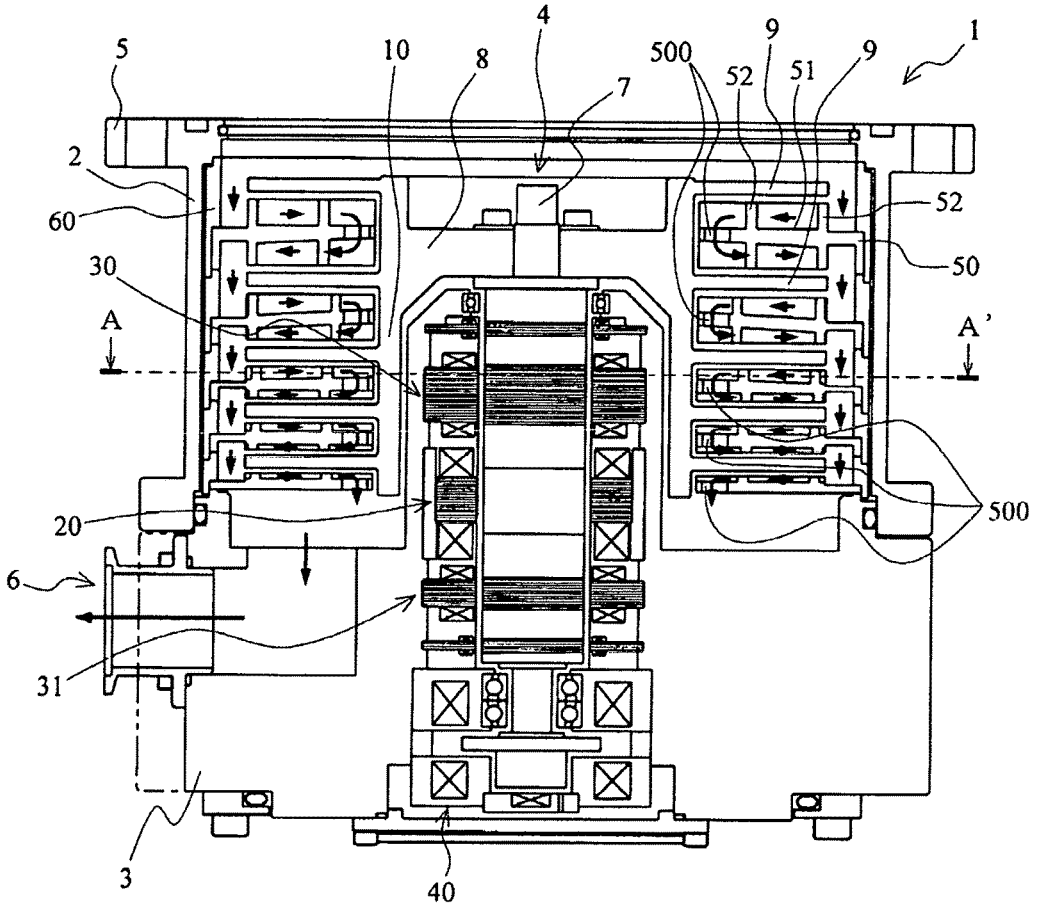
FIG. 1 is a diagram showing a schematic configuration example of a Seigbahn type molecular pump according to an embodiment of the present invention.

FIG. 1 is a diagram showing a schematic configuration example of a Seigbahn type molecular pump 1 according to the embodiment of the present invention.

Note that FIG. 1 shows a sectional view in the axial direction of the Seigbahn type molecular pump 1.

A casing 2 forming a casing of the Seigbahn type molecular pump 1 is formed in a substantially cylindrical shape. The casing 2 and a base 3 provided in a lower part (on an outlet port 6 side) of the casing 2 configure a housing of the Seigbahn type molecular pump 1. A gas transfer mechanism, which is a structure for causing the Seigbahn type molecular pump 1 to exhibit an exhaust function, is housed in the housing.

The gas transfer mechanism is roughly configured from a rotatably axially supported rotating portion and a stator portion fixed to the housing.

At an end portion of the casing 2, an inlet port 4 for introducing gas into the Seigbahn type molecular pump 1 is formed. A flange portion 5 protruding to an outer circumference side is formed on an end face on the inlet port 4 side of the casing 2.

In the base 3, the outlet port 6 for exhausting gas from the Seigbahn type molecular pump 1 is formed.

The rotating portion (a rotor portion) is configured from a shaft 7, which is a rotating shaft, a rotor 8 disposed in the shaft 7, a plurality of rotating disks 9 provided in the rotor 8, a rotating cylinder 10, and the like. Note that the rotor portion is configured by the shaft 7 and the rotor 8.

The rotating disks 9 are made of disk members formed in a disk shape radially expanding perpendicularly to the axis of the shaft 7.

The rotating cylinder 10 is made of a cylinder member formed in a cylindrical shape concentric with the rotation axis of the rotor 8.

In the middle of the axial direction of the shaft 7, a motor portion 20 for rotating the shaft 7 at high speed is provided.

Further, on the inlet port 4 side and the outlet port 6 side with respect to the motor portion 20 of the shaft 7, radial direction magnetic bearing devices 30 and 31 for supporting (axially supporting) the shaft 7 in a radial direction in a non-contact manner are provided. At the lower end of the shaft 7, an axial direction magnetic bearing device 40 for supporting (axially supporting) the shaft 7 in an axial direction in a non-contact manner is provided.

The stator portion is provided on the inner circumference side of the housing. The stator portion is configured from, for example, a plurality of stator disks 50 provided on the inlet port 4 side. Spiral grooves configured by stator disk root portions 51 and stator disk ridge portions 52 are engraved in the stator disks 50.

Note that, in this embodiment, the spiral grooves are engraved in the stator disks 50. However, not only this, but spiral groove channels only have to be engraved on gap-opposed surfaces of at least one of the rotating disks 9 and the stator disks 50.

The stator disks 50 are configured from disk members formed in a disk shape radially extending perpendicularly to the axis of the shaft 7.

The stator disks 50 in respective stages are fixed apart from one another by spacers 60 (stator portions) formed in a cylindrical shape. The height in the axial direction of the spacers 60 is set to be lower along the axial direction of the Seigbahn type molecular pump 1. Consequently, the capacity of a channel gradually decreases toward the outlet port 6 of the Seigbahn type molecular pump 1 to compress gas that passes inside the gas transfer mechanism. Arrows in FIG. 1 indicates a flow of the gas.

In the Seigbahn type molecular pump 1, the rotating disks 9 and the stator disks 50 are alternately disposed and formed in a plurality of stages in the axial direction. However, in order to satisfy discharge performance required of the vacuum pump, any number of rotor components and stator components can be provided according to necessity.

Vacuum exhaust treatment in a vacuum chamber (not shown in the figure) disposed in the Seigbahn type molecular pump 1 is performed by the Seigbahn type molecular pump 1 configured as explained above.

As shown in FIG. 1, the Seigbahn type molecular pump 1 according to the embodiment of the present invention explained above includes connection holes 500 in the disposed stator disks 50.

Variations of the connection holes provided in the stator disks 50 disposed in the Seigbahn type molecular pump 1 according to the embodiment of the present invention are separately explained below in embodiments.

FIG. 1 is a diagram showing a schematic configuration example of the Seigbahn type molecular pump 1 according to a first embodiment of the present invention.

(ii-2) First Embodiment

As shown in FIG. 1, in the stator disk 50 according to the first embodiment of the present invention, the connection holes 500 connecting the Seigbahn type molecular pump upstream region and the Seigbahn type molecular pump downstream region are provided on the inner circumferential portion (i.e., a side opposed to the rotating cylinder 10) of the stator disk 50 on which the spiral grooves are formed. The connection holes 500 are formed as turning-back connection channels.

Figure 12:
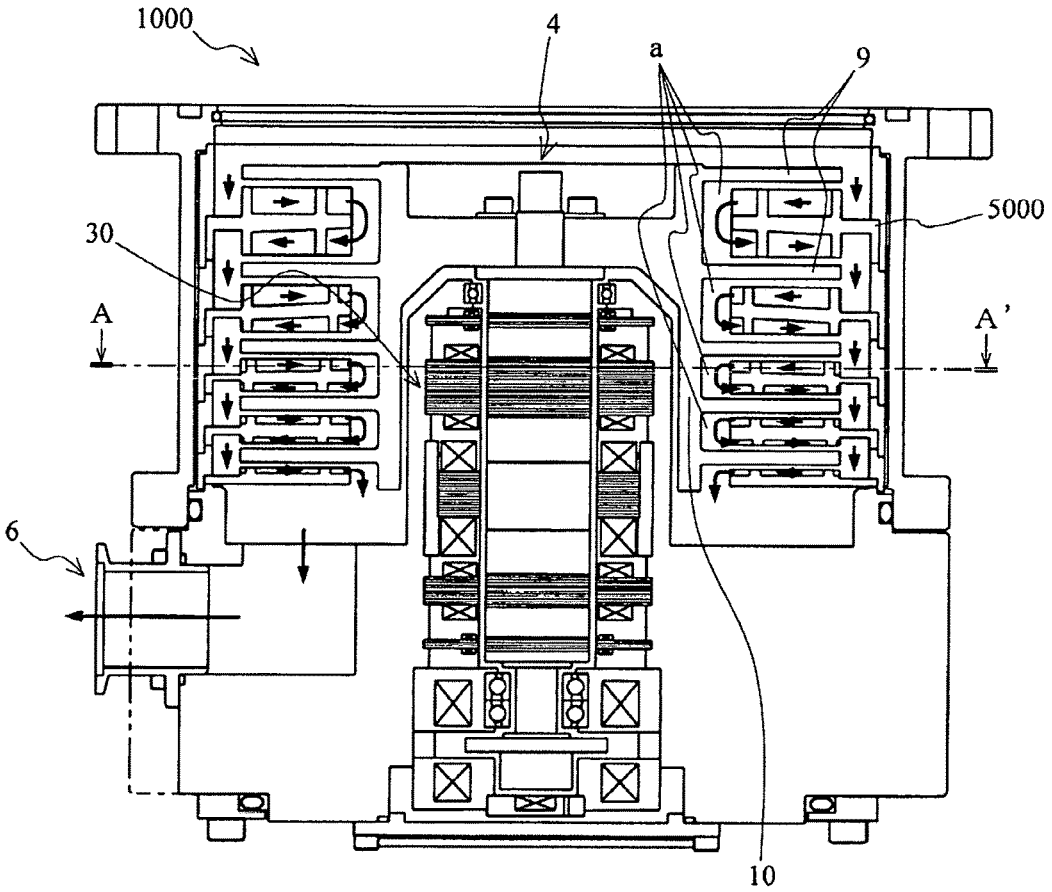
FIG. 12 is a diagram for explaining the related art and is a diagram showing a schematic configuration example of a Seigbahn type molecular pump.
Figure 13:
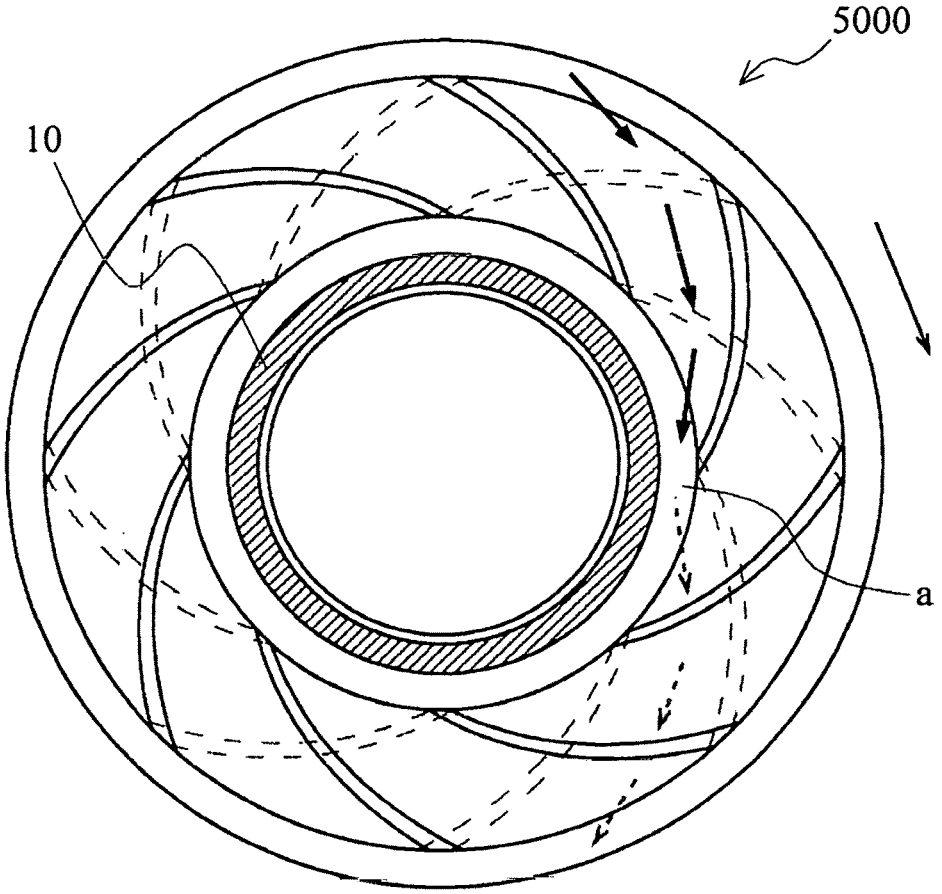
FIG. 13 is a diagram for explaining the related art and is a sectional view of a stator disk viewed from an inlet port side.

That is, in the first embodiment of the present invention, gas molecules (gas) flowing in a gas transfer mechanism region do not pass the inner turning-back channel "a" (FIGS. 12 and 13), which is a space not having exhaust action and compression action. The gas molecules pass, as connection paths for turning back, the connection holes 500 provided in a through-hole shape in the stator disk 50 that connect spaces having compression action derived by interaction of the stator disk 50 on which spiral grooves (grooves in a spiral shape formed by the stator disk root portions 51 and the stator disk ridge portions 52) are engraved and the rotating disks 9 disposed to be opposed to the stator disk 50 via a gap.

With the configuration explained above, in the Seigbahn type molecular pump 1 according to the first embodiment of the present invention, the connection holes 500 provided in portions where the spiral grooves are present on the inner side (i.e., the rotating cylinder 10 side) of the stator disk 50 connect spiral groove channels having the exhaust action (from the Seigbahn type molecular upstream region to the Seigbahn type molecular pump downstream region). The flowing gas molecules pass the connection holes 500 as the turning-back channels. Therefore, it is possible to further keep continuity of exhaust without emitting the gas molecules to a space not having the exhaust action.

(ii-3) Second Embodiment

Figure 2:
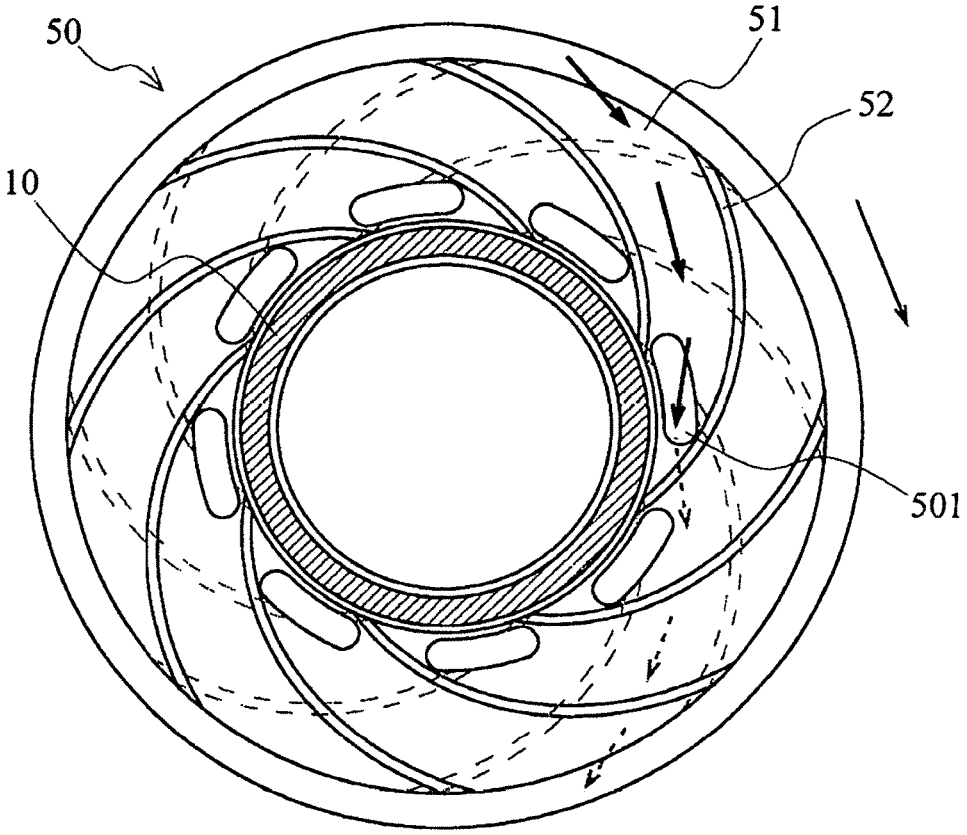
FIG. 2 is a diagram for explaining connection holes of a stator disk according to an embodiment of the present invention.

FIG. 2 is a diagram for explaining connection holes 501 of the stator disk 50 according to a second embodiment of the present invention. FIG. 2 is a sectional view of the stator disk 50 taken along line A-A' in FIG. 1 viewed from the inlet port 4 side. In the figure, spiral grooves viewed from the outlet port 6 side are indicated by broken lines.

Note that an arrow outside the stator disk 50 in FIG. 2 indicates a rotating direction of the rotating disks 9 not shown in the figure. Arrows inside the stator disk 50 indicate a part of a flow of gas molecules passing the stator disk root portions 51 of the spiral grooves.

As shown in FIG. 2, in the stator disk 50 according to the second embodiment of the present invention, the connection holes 501 are provided in the stator disk root portions 51 of one of the Seigbahn type molecular pump upstream region or the Seigbahn type molecular pump downstream region.

With the configuration explained above, in the Seigbahn type molecular pump 1 according to the second embodiment of the present invention, the connection holes 501 provided in the stator disk root portions 51 of one of the upstream side (the Seigbahn type molecular pump upstream region) or the downstream side (the Seigbahn type molecular pump downstream region) in the stator disk 50 connect the spiral groove channels having the exhaust action (from the Seigbahn type molecular upstream region to the Seigbahn type molecular pump downstream region). The flowing gas molecules pass the connection holes 501 as turning-back channels. Therefore, it is possible to further keep continuity of exhaust without emitting the gas molecules to a space not having the exhaust action.

In the second embodiment, in channels via the stator disk 50, the channels are connected with each other in the stator disk root portions 51 on one of the upstream side and the downstream side in the spiral groove of the stator disk 50. Therefore, a connection dimension of the channels can be set smaller than when the stator disk ridge portions 52 are connected with each other. As a result, in the Seigbahn type molecular pump 1 according to the second embodiment of the present invention, it is possible to turn back the gas molecules with smaller exhaust resistance.

(ii-4) Third Embodiment

Figure 3:
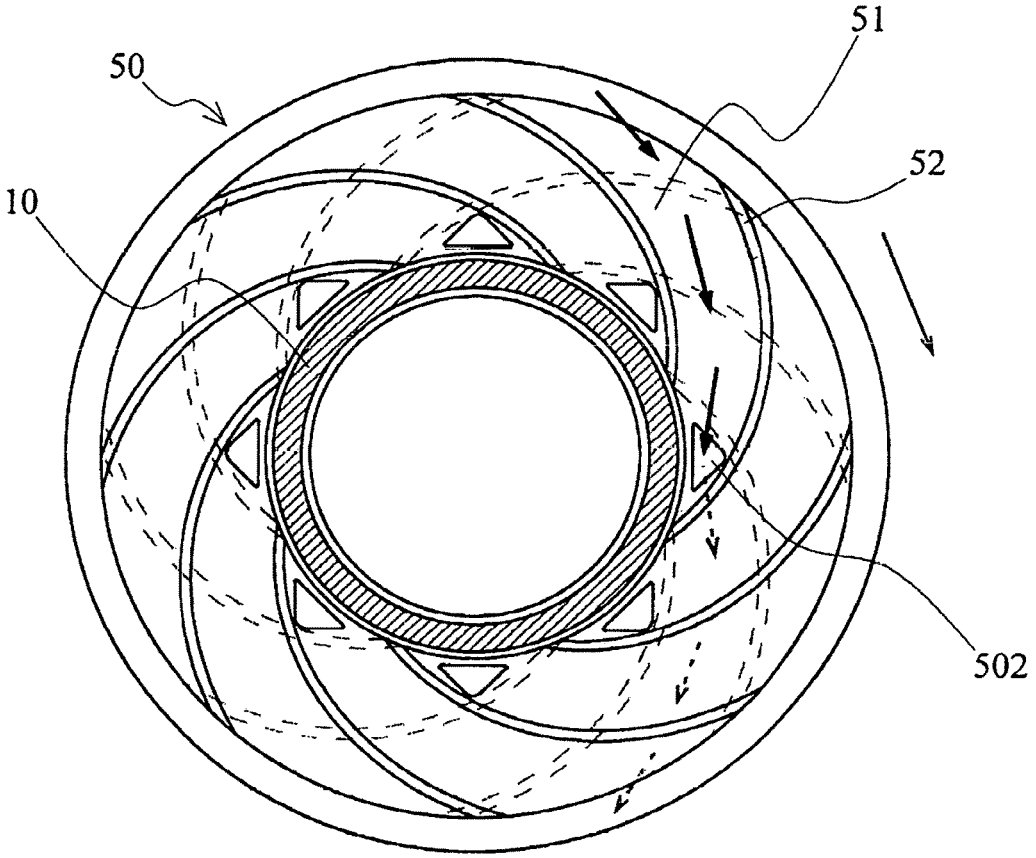
FIG. 3 is a diagram for explaining connection holes of the stator disk according to an embodiment of the present invention.

FIG. 3 is a diagram for explaining connection holes 502 of the stator disk 50 according to a third embodiment of the present invention. FIG. 3 is a sectional view of the stator disk 50 taken along line A-A' in FIG. 1 viewed from the inlet port 4 side. In the Figure, spiral grooves viewed from the outlet port 6 side are indicated by broken lines.

Note that an arrow outside the stator disk 50 in FIG. 3 indicates a rotating direction of the rotating disks 9 not shown in the figure. Arrows inside the stator disk 50 indicate a part of a flow of gas molecules passing the stator disk root portions 51 of the spiral grooves.

As shown in FIG. 3, in the stator disk 50 according to the third embodiment of the present invention, the connection holes 502 that connect the stator disk root portions 51 in the Seigbahn type molecular pump upstream region with the stator disk root portions 51 in the Seigbahn type molecular pump downstream region are provided.

That is, in the third embodiment, the connection holes 502 formed in the stator disk 50 are through-holes that connect together the root portions (the stator disk root portions 51) of the spiral grooves provided on both the surfaces on the upstream side and the downstream side of the stator disk 50.

With the configuration explained above, in the Seigbahn type molecular pump 1 according to the third embodiment of the present invention, the connection holes 502 formed in the stator disk 50 are through-holes penetrating from the stator disk root portions 51 engraved on the upstream side (the Seigbahn type molecular pump upstream region) to the stator disk root portions 51 engraved on the downstream side (the Seigbahn type molecular pump downstream region) in the stator disk 50. The connection holes 502 connect the spiral groove channels having the exhaust action (from the Seigbahn type molecular pump upstream region to the Seigbahn type molecular pump downstream region), whereby the flowing gas molecules pass the connection holes 502 as the turning-back channels. Therefore, it is possible to further keep continuity of exhaust without emitting the gas molecules to a space not having the exhaust action. Further, since the root portions of the channels are connected with each other, a connection dimension of the channels is minimized. It is possible to turn back the gas molecules with smaller exhaust resistance.

(ii-5) Fourth Embodiment

Figure 4:
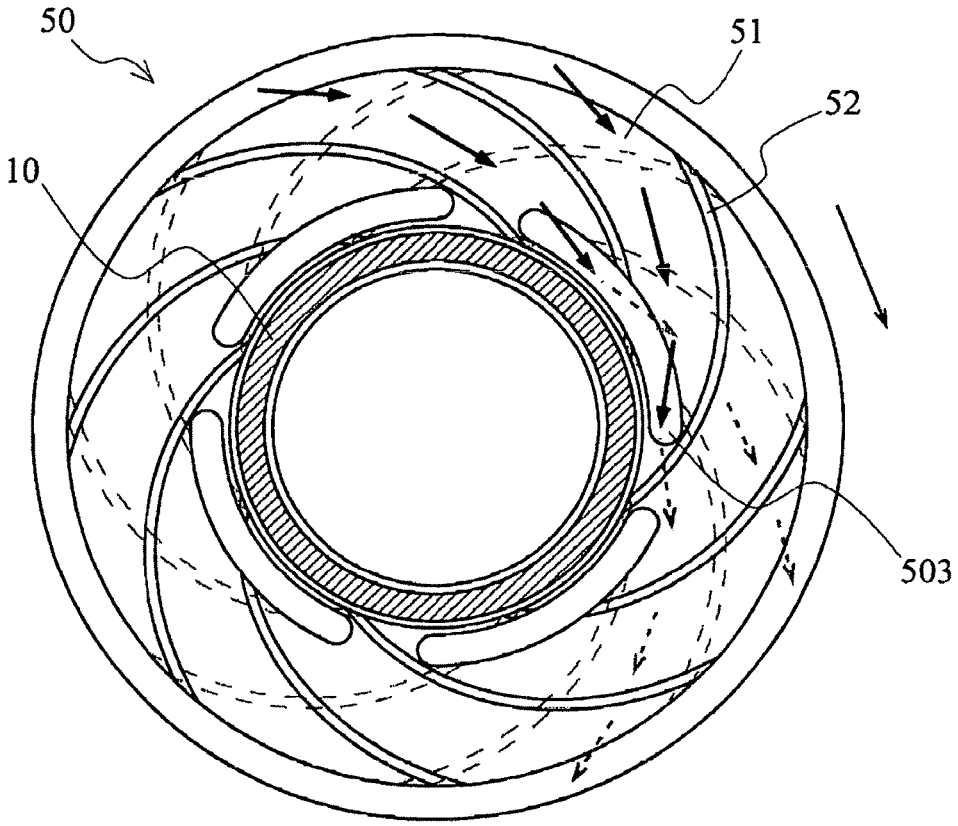
FIG. 4 is a diagram for explaining connection holes of the stator disk according to an embodiment of the present invention.

FIG. 4 is a diagram for explaining connection holes 503 of the stator disk 50 according to a fourth embodiment of the present invention. FIG. 4 is a sectional view of the stator disk 50 taken along line A-A' in FIG. 1 viewed from the inlet port 4 side. In the figure, spiral grooves viewed from the outlet port 6 side are indicated by broken lines.

Note that an arrow outside the stator disk 50 in FIG. 4 indicates a rotating direction of the rotating disks 9 not shown in the figure. Arrows inside the stator disk 50 indicate a part of a flow of gas molecules passing the stator disk root portions 51 of the spiral grooves.

As shown in FIG. 4, in the stator disk 50 according to the fourth embodiment of the present invention, the connection holes 503 formed in a plurality of root portions at an end of the outlet port 6 in the Seigbahn type molecular pump upstream region or a plurality of root portions at an end of the inlet port 4 in the Seigbahn type molecular pump downstream region.

That is, in the fourth embodiment, as the connection holes 503 formed in the stator disk 50, one connection hole does not need to correspond to one root portion. The connection hole is provided across root portions of a plurality of pitches.

Note that the number of spiral grooves connected to one connection hole 503 changes according to pressure in the spiral grooves. Therefore, it is desirable to optionally select the number of spiral grooves in terms of design.

With the configuration explained above, in the Seigbahn type molecular pump 1 according to the fourth embodiment of the present invention, the connection holes 503 formed in the stator disk 50 are through-holes penetrating from the stator disk root portions 51 engraved on the upstream side (the Seigbahn type molecular pump upstream region) to the stator disk root portions 51 engraved on the downstream side (the Seigbahn type molecular pump downstream region) in the stator disk 50. The connection holes 503 connect the spiral groove channels having the exhaust action (from the Seigbahn type molecular pump upstream region to the Seigbahn type molecular pump downstream region) across root portions of a plurality of pitches, whereby the flowing gas molecules pass the connection holes 503 as the turning-back channels. Therefore, it is possible to further keep continuity of exhaust without emitting the gas molecules to a space not having the exhaust action. Further, since the root portions of the channels are connected with each other, a connection dimension of the channels is minimized. It is possible to turn back the gas molecules with smaller exhaust resistance.

(ii-6-1) Fifth Embodiment

Figure 5:
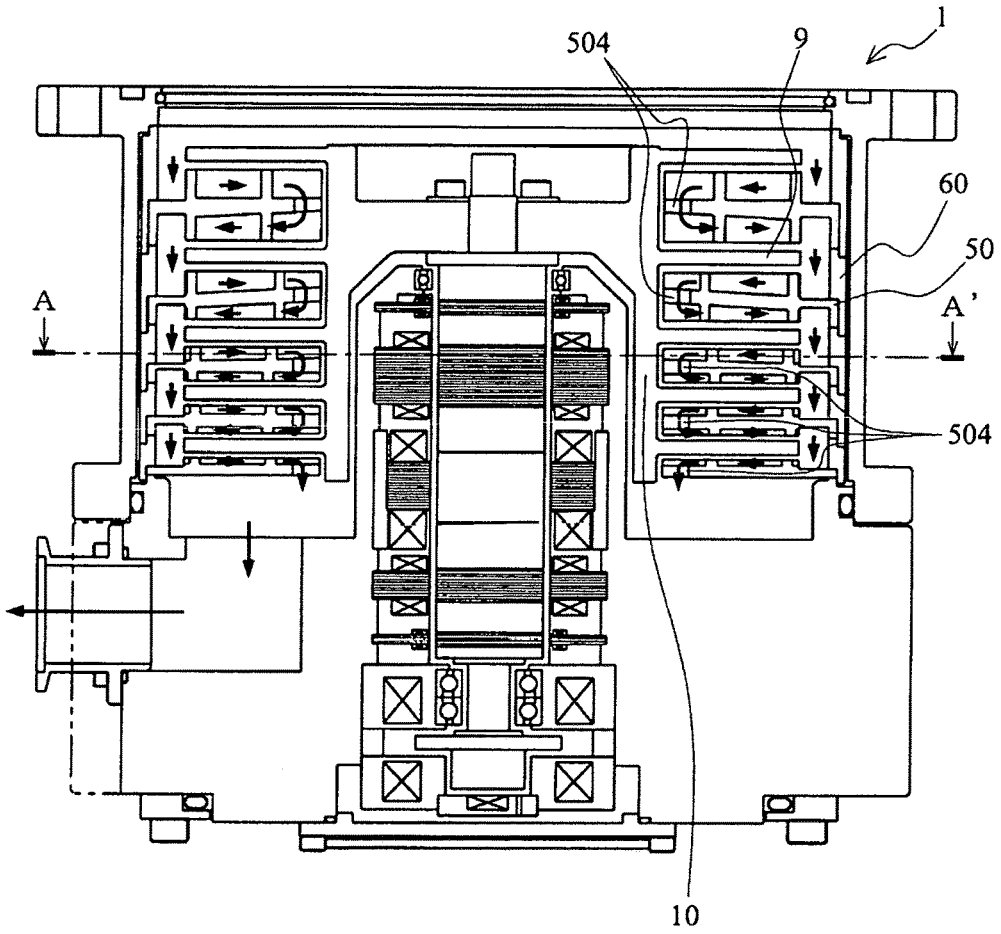
FIG. 5 is a diagram showing a schematic configuration example of the Seigbahn type molecular pump according to an embodiment of the present invention.
Figure 6:
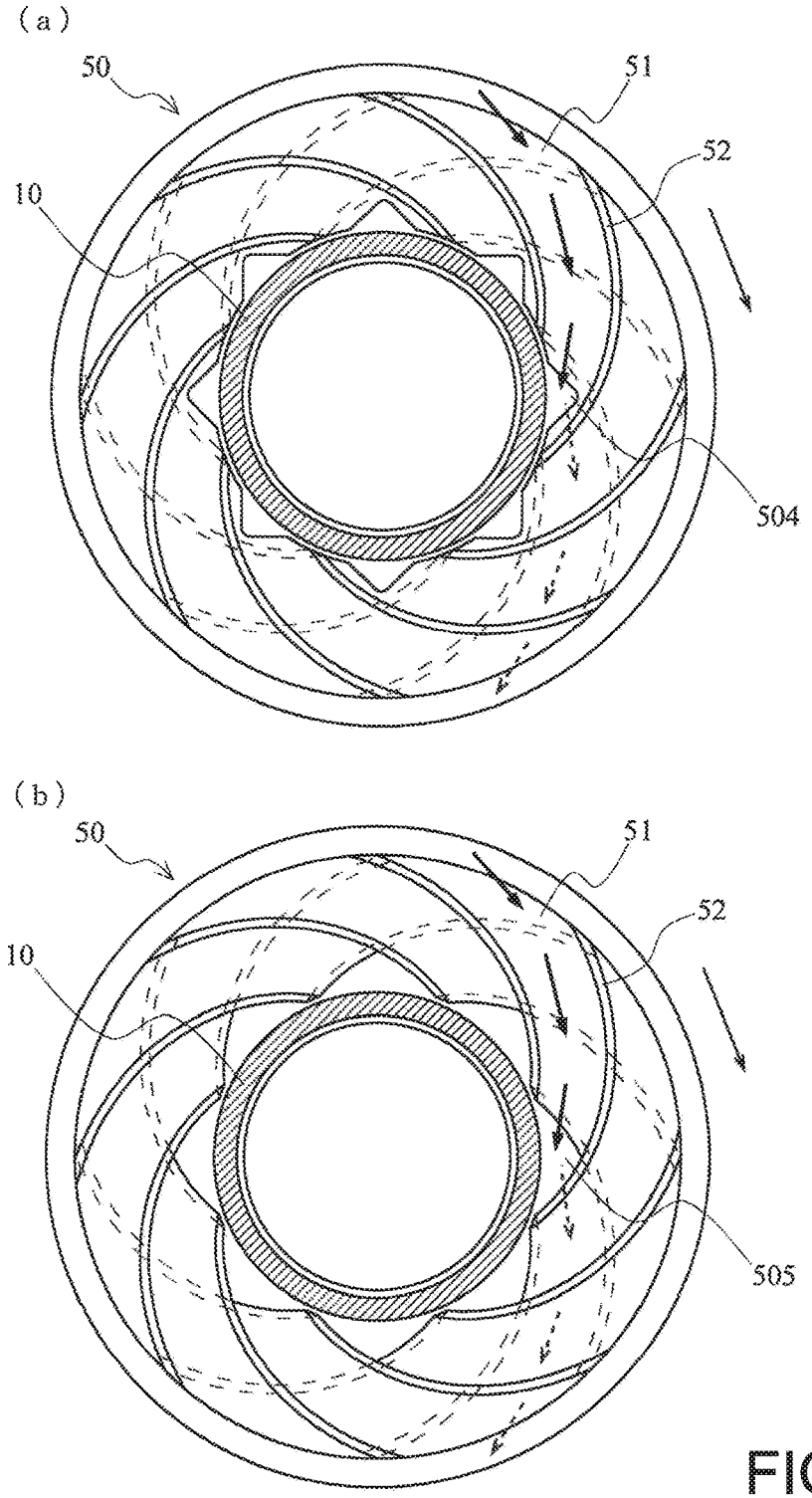
FIGS. 6A and 6B are diagrams for explaining connection holes of the stator disk according to an embodiment of the present invention.
Figure 7:
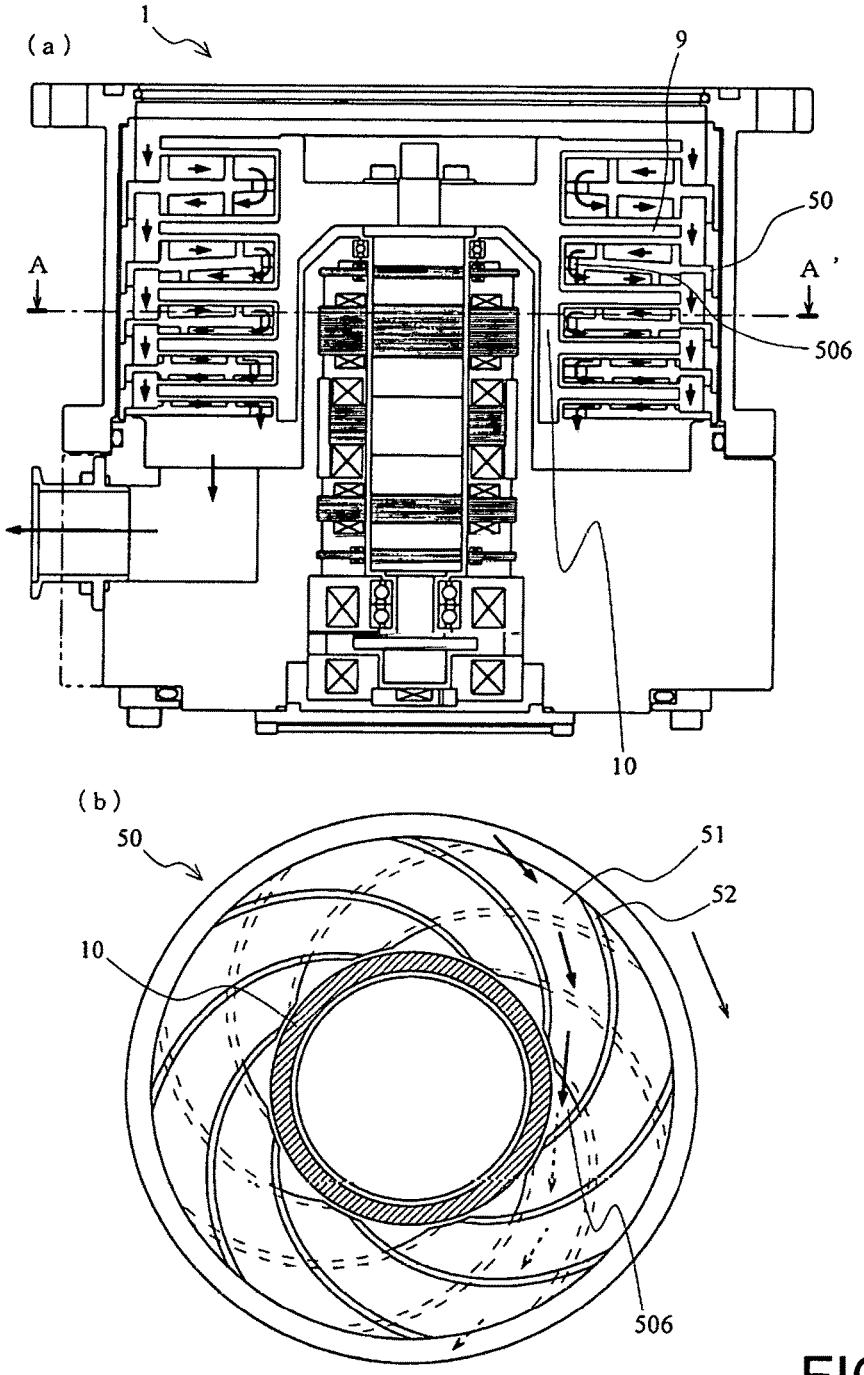
FIGS. 7A and 7B are diagrams for explaining connection holes of the stator disk according to an embodiment of the present invention.
Figure 8:
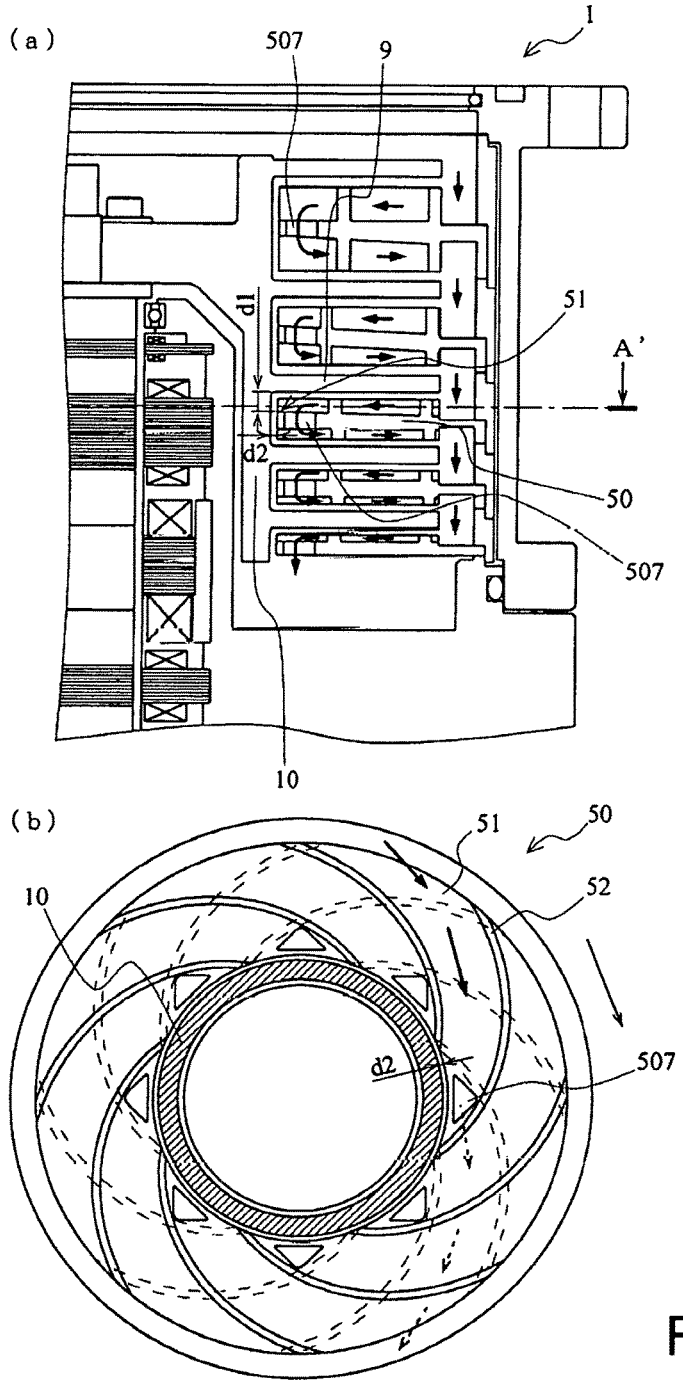
FIGS. 8A and 8B are diagrams for explaining connection holes of the stator disk according to an embodiment of the present invention.
Figure 9:
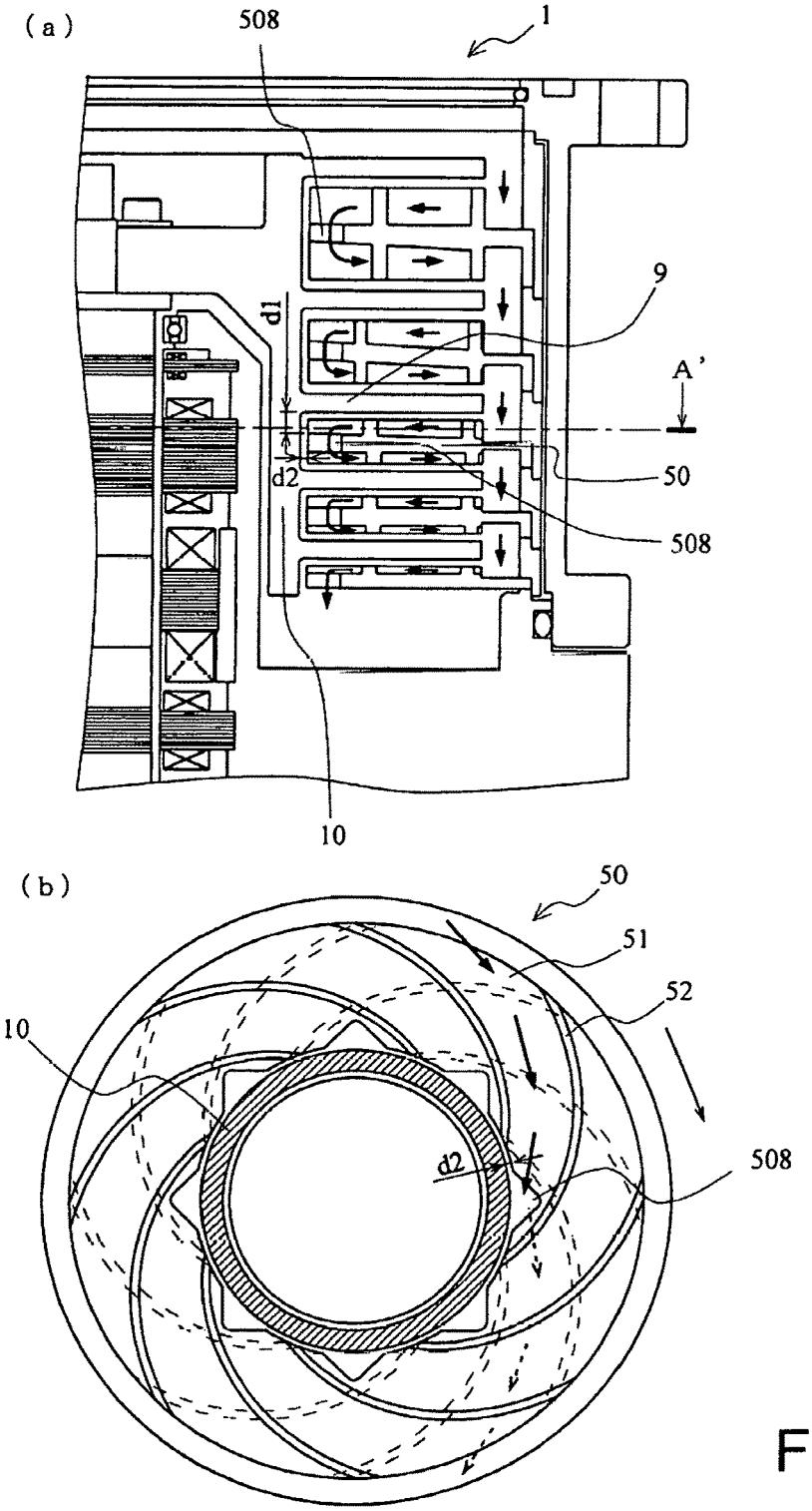
FIGS. 9A and 9B are diagrams for explaining connection holes of the stator disk according to an embodiment of the present invention.

FIG. 5 is a diagram showing a schematic configuration example of the Seigbahn type molecular pump 1 according to a fifth embodiment of the present invention. Note that explanation of components same as the components shown in FIG. 1 is omitted.

FIGS. 6A and 6B are sectional views of the stator disk 50 taken along line A-A' in FIG. 5 viewed from the inlet port 4 side. In the figures, spiral grooves viewed from the outlet port 6 side are indicated by broken lines.

Note that an arrow outside the stator disk 50 in FIGS. 6A and 6B indicates a rotating direction of the rotating disks 9 not shown in the figure. Arrows inside the stator disk 50 indicate a part of a flow of gas molecules passing the stator disk root portions 51 of the spiral groove.

As shown in FIG. 5 and FIGS. 6A and 6B, the Seigbahn type molecular pump 1 according to the fifth embodiment of the present invention includes connection holes 504 (505) in the disposed stator disk 50.

More specifically, in the stator disk 50 according to the fifth embodiment of the present invention, as shown in FIG. 6A, on the inner circumferential portion (i.e., a side opposed to the rotating cylinder 10) of the stator disk 50 in which the spiral grooves are formed, the connection holes 504 that connect the Seigbahn type molecular pump upstream region and the Seigbahn type molecular pump downstream region are disposed in a state in which the connection holes 504 open to a gap formed by the outer diameter surface of the rotating cylinder 10 and the inner diameter surface (i.e., a side not fixed by the spacers 60) of the stator disk 50. When being turned back from upstream to downstream, the gas molecules pass the connection holes 504 as turning-back connection channels.

That is, in the fifth embodiment of the present invention, the gas molecules passing the gas transfer mechanism pass, as connection paths in turning back, for turning back, the connection holes 504 provided in an opening shape in the rotating cylinder 10 that connect spaces having compression action derived by interaction of the stator disk 50 on which spiral grooves (grooves in a spiral shape formed by the stator disk root portions 51 and the stator disk ridge portions 52) are engraved and the rotating disks 9 disposed to be opposed to the stator disk 50 via a gap.

(ii-6-2) Modifications of the Fifth Embodiment

The configuration of the fifth embodiment explained above can be combined with the configurations of the connection holes (500, 501, 502, and 503) in the first to fourth embodiments as modifications of the first to fourth embodiments.

FIG. 6B is a diagram for explaining, as an example, a modification in which the third embodiment and the fifth embodiment are combined. As shown in FIG. 6B, for example, when the connection holes 502 (FIG. 3) according to the third embodiment of the present invention are combined with the connection holes 504 according to the fifth embodiment, it is possible to form connection holes 505 in which a large channel area can be secured when the gas molecules are turned back from upstream to downstream. It is possible to efficiently perform exhaust treatment.

With the configuration explained above, in the Seigbahn type molecular pump 1 according to the fifth embodiment of the present invention and the modifications in which the fifth embodiment and any one of the first embodiment to fourth embodiment are combined, both of space regions of the connection holes 504 (505) and a gap region formed by the outer diameter surface of the rotating cylinder 10 and the inner diameter surface of the stator disk 50 can be used as turning-back channels all together. Therefore, it is possible to maximize a dimension in the radial direction of the Seigbahn type molecular pump 1. As a result, it is possible to prevent an increase in the size of the apparatus and provide the Seigbahn type molecular pump 1 having high exhaust efficiency.

A momentum to a tangential direction movement side of the rotating disks 9 is always given to the gas molecules (the gas) transferred in the Seigbahn type molecular pump 1. Then, on the upstream side, the pressure of a wall on the tangential direction movement side (the forward side) of the rotating disks 9 is always high.

As explained above, in the Seigbahn type molecular pump 1, the rotating disks 9 give the momentum in the tangential direction to the gas molecules. Therefore, according to a pressure distribution diagram on the upstream (inlet port 4) side and the downstream (the outlet port 6) side of one stator disk 50 disposed in the Seigbahn type molecular pump 1, in the spiral groove conduit, pressure near the rotating disk ridge portions 52 (the stator disk 50) located in the rotating direction of the rotating disks 9 tends to be high. Pressure tends to be the highest at an end of the outlet port 6 side. On the other hand, pressure near the rotating disk ridge portions 52 (the stator disk 50) on the opposite side to the rotating direction of the rotating disks 9 tends to be low. Pressure tends to be the lowest at an end of the inlet port 4 side.

Therefore, in a sixth embodiment, connection holes 506 that connect regions with high pressure on the upstream surface of the stator disk 50 and regions with low pressure on the downstream surface of the stator disk 50, that is, connect regions having a pressure difference are formed in the stator disk 50.

(ii-7) Sixth Embodiment

FIGS. 7A and 7B are diagrams for explaining the connection holes 506 of the stator disk 50 according to the sixth embodiment of the present invention. Note that explanation of components same as the components shown in FIG. 1 is omitted.

FIG. 7A shows a schematic configuration example of the Seigbahn type molecular pump 1 according to the sixth embodiment of the present invention. As shown in FIG. 7A, in the sixth embodiment, phases of spiral grooves formed on both the upper and lower surfaces of the stator disk 50 are shifted not to be the same on the upper surface and the lower surface.

FIG. 7B is a sectional view of the stator disk 50 taken along line A-A' in FIG. 7A viewed from the inlet port 4 side. In the figure, spiral grooves viewed from the outlet port 6 side are indicated by broken lines.

Note that an arrow outside the stator disk 50 in FIG. 7B indicates a rotating direction of the rotating disks 9 not shown in the figure. Arrows inside the stator disk 50 indicate a part of a flow of gas molecules passing the stator disk root portions 51 of the spiral grooves.

As shown in FIGS. 7A and 7B, the Seigbahn type molecular pump 1 according to the sixth embodiment of the present invention includes the connection holes 506 in the disposed stator disk 50.

More specifically, in the stator disk 50 according to the sixth embodiment of the present invention, as shown in FIGS. 7A and 7B, on the upstream region (the Seigbahn type molecular pump upstream region) side of the inner circumferential portion (i.e., a side opposed to the rotating cylinder 10) in the stator disk 50 in which the spiral grooves are formed, the connection holes 506 are formed in a part of a place on the rotation moving direction side of the rotating disks 9 rather than all regions of the stator disk root portions 51 of the spiral grooves.

On the other hand, opening tips of the connection holes 506 on the downstream region (the Seigbahn type molecular pump downstream region) side of the stator disk 50 corresponding to the opening portions of the connection holes 506 on the upstream region side are formed to be connected with a part of a place on the opposite side to the rotation moving direction side of the rotating disks 9 rather than all regions of the stator disk root portions 51 of the spiral grooves in the Seigbahn type molecular pump downstream region.

That is, in the sixth embodiment of the present invention, the gas molecules passing the gas transfer mechanism pass regions with high pressure on the upstream surface (the Seigbahn type molecular pump upstream region) of the stator disk 50 on which the spiral grooves (the grooves of the spiral shape formed by the stator disk root portions 51 and the stator disk ridge portions 52) are formed and regions with low pressure on the downstream surface (the Seigbahn type molecular pump downstream region) of the stator disk 50. That is, the gas molecules pass, as connection paths for turning back, the connection holes 506 that connect the regions having a pressure difference.

With the configuration explained above, in the Seigbahn type molecular pump 1 according to the sixth embodiment of the present invention, the connection holes 506 passing the stator disk root portions 51 near the stator disk ridge portions 52 downstream in the rotating direction in the spiral grooves engraved on the upstream surface (the Seigbahn type molecular pump upstream region) of the stator disk 50 and the stator disk root portions 51 near the stator disk ridge portions 52 upstream in the rotating direction and on the opposite side in the rotating direction in the spiral grooves engraved on the downstream surface (the Seigbahn type molecular pump downstream region) are used as the turning-back channels for the gas molecules. Therefore, a pressure difference in a connecting portion that connects the upstream surface and the downstream surface of the stator disk 50 (connects the upstream surface with the downstream surface) is maximized. Resistance received by the turning-back gas molecules is minimized.

As a result, it is possible to most efficiently turn back and transfer the gas molecules according to a pressure distribution generated in the Seigbahn type molecular pump 1. Therefore, it is possible to provide the Seigbahn type molecular pump 1 having high exhaust efficiency.

(ii-8-1) Seventh Embodiment

FIGS. 8A and 8B and FIGS. 9A and 9B are diagrams for explaining connection holes 507 of the stator disk 50 according to a seventh embodiment of the present invention.

FIG. 8A shows a schematic configuration example of the Seigbahn type molecular pump 1 according to the seventh embodiment of the present invention. Explanation of components same as the components shown in FIG. 1 is omitted.

As shown in FIG. 8A, the Seigbahn type molecular pump 1 according to the seventh embodiment of the present invention includes the connection holes 507 in the disposed stator disk 50.

In the seventh embodiment of the present invention, as shown in FIG. 8A, a gap d2 between the rotating cylinder 10 and the stator disk 50 excluding the connection holes 507 is set to be smaller than depth d1 of exhaust grooves in the Seigbahn type molecular pump upstream region.

That is, the gap (d2) that the gas molecules pass when turning back is set smaller than the width (width of a channel) d1 formed by the rotating disks 9 and the stator disk root portions 51 on the inlet port 4 side of the stator disk 50.

Note that, in the seventh embodiment, length from the surface on the inlet port 4 side of the stator disk 50 to the bottom surfaces of the stator disk root portions 51 is referred to as "depth of exhaust grooves".

With the configuration explained above, in the Seigbahn type molecular pump 1 according to the seventh embodiment of the present invention, the transfer of the gas molecules via the connection holes 507 is predominant over the transfer of the gas molecules in the gap (d2) formed by the outer diameter surface of the rotating cylinder 10 and the inner diameter surface of the stator disk 50. Therefore, it is possible to efficiently turn back and transfer the gas molecules. Therefore, it is possible to provide the Seigbahn type molecular pump 1 with high exhaust efficiency.

(ii-8-2) Modifications of the Seventh Embodiment

The configuration of the seventh embodiment explained above can be combined with the configurations of the connection holes (500, 501, 502, 503, 504, 505, and 506) in the first to sixth embodiments as modifications of the first to sixth embodiments.

Two examples of the combination are explained below.

(1) The Third Embodiment and the Seventh Embodiment . . . Solving Means 7-1 (507)

FIG. 8B is a diagram for explaining a modification (connection holes 507) in which the third embodiment and the seventh embodiment are combined. FIG. 8B is a sectional view of the stator disk 50 taken along line A-A' in FIG. 8A viewed from the inlet port 4 side. In the figure, spiral grooves viewed from the outlet port 6 side are indicated by broken lines.

Note that an arrow outside the stator disk 50 in FIG. 8B indicates a rotating direction of the rotating disks 9 not shown in the figure. Arrows inside the stator disk 50 indicate a part of a flow of gas molecules passing the stator disk root portions 51 of the spiral grooves.

As shown in FIG. 8B, for example, when the connection holes 502 (FIG. 3) that connect together the root portions (the stator disk root portions 51) of the spiral grooves according to the third embodiment of the present invention are combined with the connection holes (507) according to the seventh embodiment, it is possible to keep continuity of exhaust without emitting the gas molecules to a space not having the exhaust action. Further, since the root portions of the channels are connected with each other, a connection dimension of the channels is minimized. It is possible to form the connection holes 507 that can turn back the gas molecules with smaller exhaust resistance.

(2) The Fifth Embodiment and the Seventh Embodiment . . . Solving Means 7-2 (508)

FIGS. 9A and 9B are diagrams for explaining a modification (connection holes 508) in which the fifth embodiment and the seventh embodiment are combined.

FIG. 9B is a sectional view of the stator disk 50 taken along line A-A' in FIG. 9A viewed from the inlet port 4 side. In the figure, spiral grooves viewed from the outlet port 6 side are indicated by broken lines.

Note that an arrow outside the stator disk 50 in FIG. 9B indicates a rotating direction of the rotating disks 9 not shown in the figure. Arrows inside the stator disk 50 indicate a part of a flow of gas molecules passing the stator disk root portions 51 of the spiral grooves.

As shown in FIG. 9B, for example, when the connection holes 504 (FIG. 6A) disposed to be opened to the gap formed by the outer diameter surface of the rotating cylinder 10 and the inner diameter surface of the stator disk 50 are combined with the connection holes (507) according to the seventh embodiment, the connection holes 508 shown in FIG. 9B are formed.

With this configuration, in this modification, both of space regions of the connection holes and a gap region formed by the outer diameter surface of the rotating cylinder 10 and the inner diameter surface of the stator disk 50 can be used as turning-back channels all together. Therefore, in addition to maximizing a dimension in the radial direction of the Seigbahn type molecular pump 1 without an increase in the size of the apparatus, it is possible to form connection holes 508 in which a large channel area can be secured when the gas molecules are turned back from upstream to downstream. It is possible to efficiently perform exhaust treatment.

(ii-9) Eighth Embodiment

An eighth embodiment of the present invention is combined with the configurations of the connection holes (500 to 508) explained in the first to seventh embodiments as modifications of the first to seventh embodiments of the present invention.

Connection holes according to the eighth embodiment of the present invention are formed such that, in any one of the configurations explained in the first to seventh embodiments, the cross-sectional area of the gap (d2 in FIGS. 8A and 8B and FIGS. 9A and 9B) between the rotating cylinder 10 and the stator disk 50 excluding the connection holes is smaller than the cross-sectional area of an exhaust groove channel on the upstream side (the Seigbahn type molecular pump upstream region).

The "cross-sectional area of the exhaust groove channel" in the eight embodiment indicates a circumferential cross-sectional area at a certain radius of the stator disk 50.

With this configuration, when the gas molecules turn back from upstream to downstream across the stator disk 50, as an amount of the passing gas molecules, an amount of the gas molecules passing the connection holes can be set larger than an amount of the gas molecules passing the gap formed by the rotating disks 9 and the stator disk 50. Therefore, the connection holes are mainly used as turning-back channels.

With the configuration explained above, in the Seigbahn type molecular pump 1 according to the eighth embodiment of the present invention, the transfer of the gas molecules via the connection holes is predominant over the transfer of the gas molecules in the gap (d2 in FIGS. 8A and 8B and FIGS. 9A and 9B) formed by the outer diameter surface of the rotating cylinder 10 and the inner diameter surface of the stator disk 50. Therefore, it is possible to efficiently turn back and transfer the gas molecules. It is possible to realize high exhaust efficiency.

(ii-10) Ninth Embodiment

Figure 10:
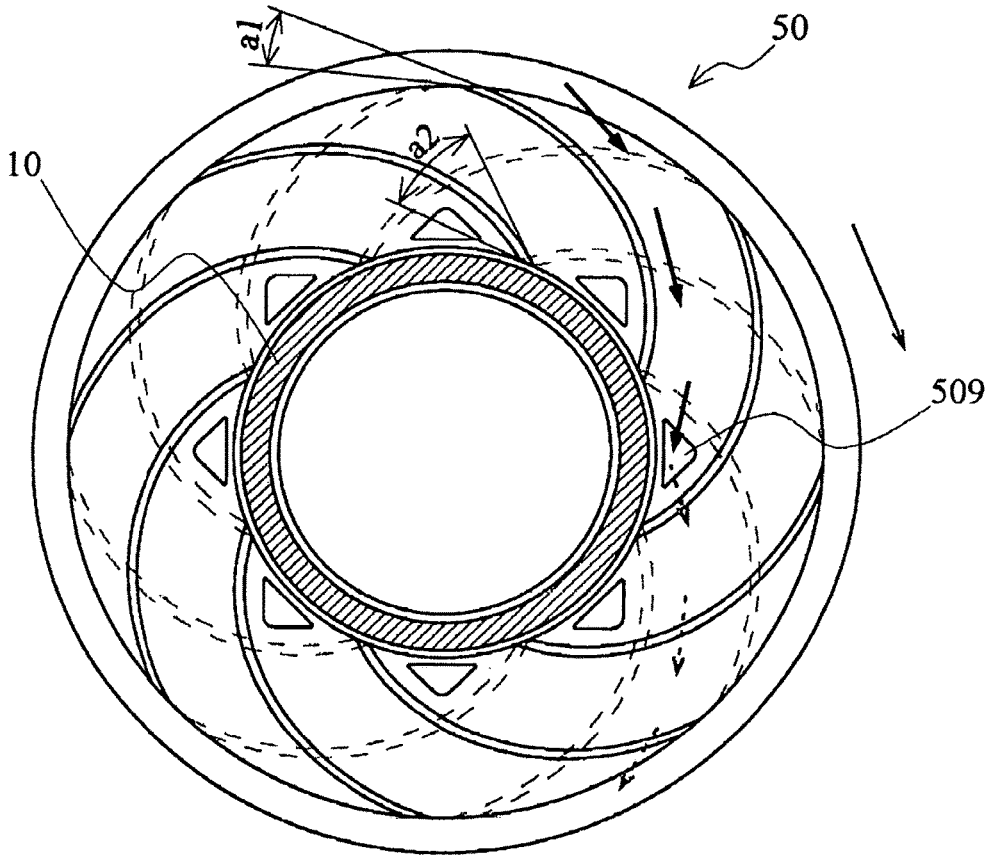
FIG. 10 is a diagram for explaining connection holes according to an embodiment of the present invention and is a sectional view of the stator disk viewed from an inlet port side.

FIG. 10 is a diagram for explaining connection holes 509 according to a ninth embodiment of the present invention and is a sectional view of the stator disk 50 viewed from the inlet port 4 side.

The stator disk 50 according to the ninth embodiment is configured such that, as tangential angles of circumferential grooves indicated by a1 and a2 in FIG. 10, the tangential angle a2 on the stator disk inner side is larger than the tangential angle a1 on the stator disk outer side in FIG. 10 (a1<a2).

That is, the stator disk 50 according to the ninth embodiment is configured such that a tangential angle of circumferential grooves on the inner side (i.e., a side opposed to the rotating cylinder 10), which is a side on which the connection holes 509 are disposed, is larger. Therefore, when the number of grooves is the same, the width on the inner side is larger.

With the configuration explained above, in the Seigbahn type molecular pump 1 according to the ninth embodiment of the present invention, the size of the connection holes 509 formed in the stator disk 50 can be increased as much as possible. Therefore, it is possible to secure large exhaust conductance. As a result, it is possible to provide the Seigbahn type molecular pump 1 more excellent in exhaust efficiency.

The configuration of the ninth embodiment may be applied when not only the stator disk 50 but also a stator disk on which spiral grooves are formed is used. Further, the configuration may be combined with the configurations of the connection holes (500 to 508) in the first to eighth embodiments as modifications of the first to eighth embodiments.

(ii-11) Tenth Embodiment

Figure 11:
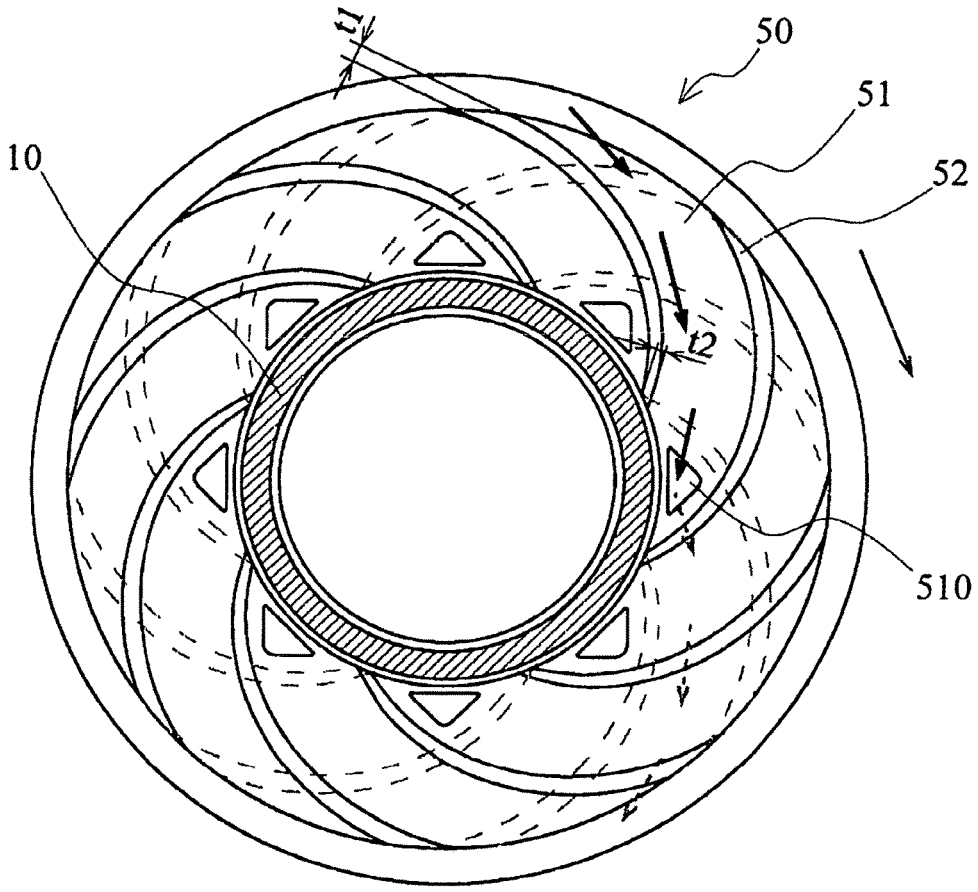
FIG. 11 is a diagram for explaining connection holes according to an embodiment of the present invention and is a sectional view of the stator disk viewed from the inlet port side.

FIG. 11 is a diagram for explaining connection holes 510 according to a tenth embodiment of the present invention and is a sectional view of the stator disk 50 viewed from the inlet port 4 side.

The stator disk 50 according to the tenth embodiment is configured such that, as the ridge width (i.e., the width of the peaks of the stator disk ridge portions 52) of circumferential grooves indicated by t1 and t2 in FIG. 11, the ridge width t2 on the stator disk inner side is smaller than the ridge width t1 on the stator disk outer side (t1>t2).

That is, the stator disk 50 according to the tenth embodiment is configured such that the ridge width of the stator disk ridge portions 52 of the circumferential grooves on the inner side (i.e., a side opposed to the rotating cylinder 10), which is a side on which the connection holes 510 are disposed, is smaller. Therefore, when the number of grooves is the same, a larger space of the stator disk root portions 51 on the inner side can be secured.

With the configuration explained above, in the Seigbahn type molecular pump 1 according to the tenth embodiment of the present invention, the size of the connection holes 510 formed in the stator disk 50 can be increased as much as possible. Therefore, it is possible to secure large exhaust conductance. As a result, it is possible to provide the Seigbahn type molecular pump 1 more excellent in exhaust efficiency.

The configuration of the tenth embodiment may be applied when not only the stator disk 50 but also a stator disk on which spiral grooves are formed is used. Further, the configuration may be combined with the configurations of the connection holes (500 to 509) in the first to ninth embodiments as modifications of the first to ninth embodiments.

Note that the respective embodiments and the respective modifications may be combined.

The connection holes in the embodiments and the modifications are not limited to be provided in the axial direction and may be provided obliquely with respect to the axial direction. For example, by opening the connection holes obliquely in the rotating direction, a flow of exhausted gas is smoothed. It is possible to further improve exhaust performance.

The embodiments of the invention are not limited to the Seigbahn type molecular pump. The embodiments can also be applied to a complex type turbo molecular pump including a Seigbahn type molecular pump portion and a turbo molecular pump portion, a complex type turbo molecular pump including the Seigbahn type molecular pomp portion and a screw groove type pump portion, or a complex type turbo molecular pump (vacuum pump) including the Seigbahn type molecular pump portion, the turbo molecular pump portion, and the screw groove type pump portion.

Figure 16:
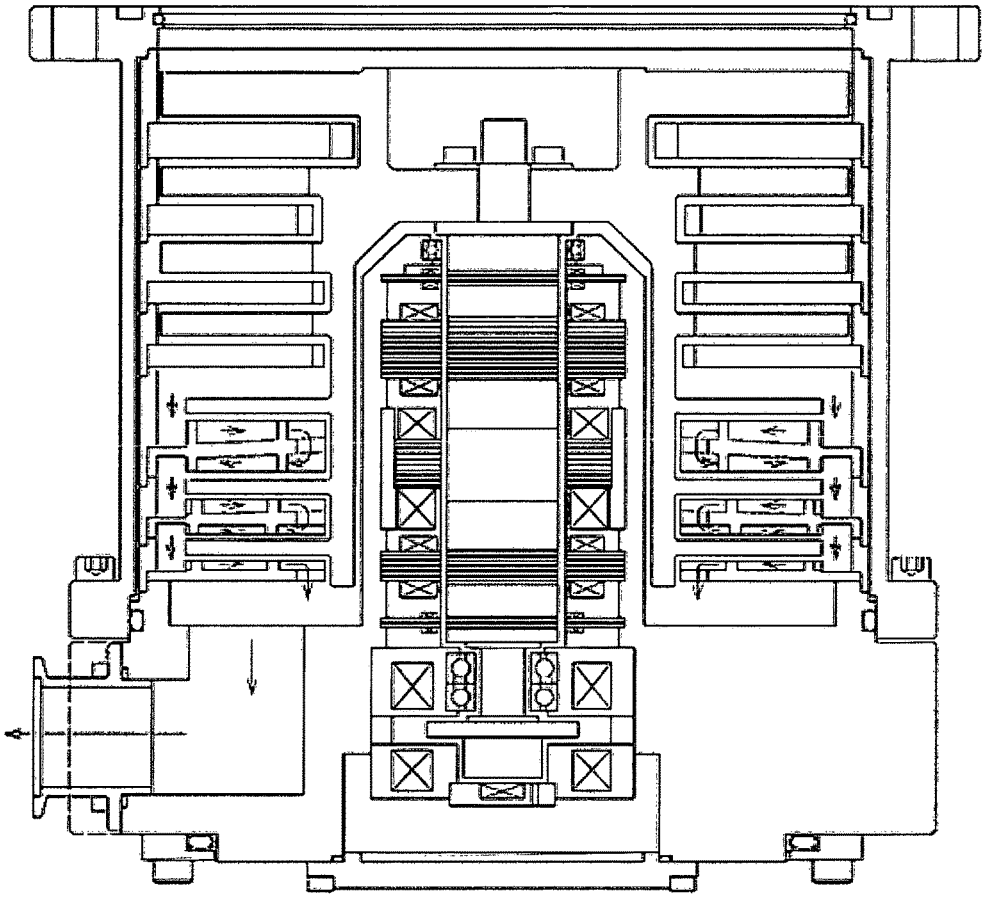
FIG. 16 is a diagram showing a schematic configuration example of a complex pump with a Seigbahn type pump portion and a molecular pump portion according to an embodiment; of the present invention.

In the case of the complex type vacuum pump including the turbo molecular pump portion, shown in the FIG. 16, a rotating portion including a rotating shaft and a rotating body fixed to the rotation axis is further provided. Rotor blades (moving blades) are disposed in multiple stages. The complex type vacuum pump further includes a stator portion in which stator blades (stationary blades) are disposed in multiple stages alternately with respect to the rotor blades.

Figure 14:
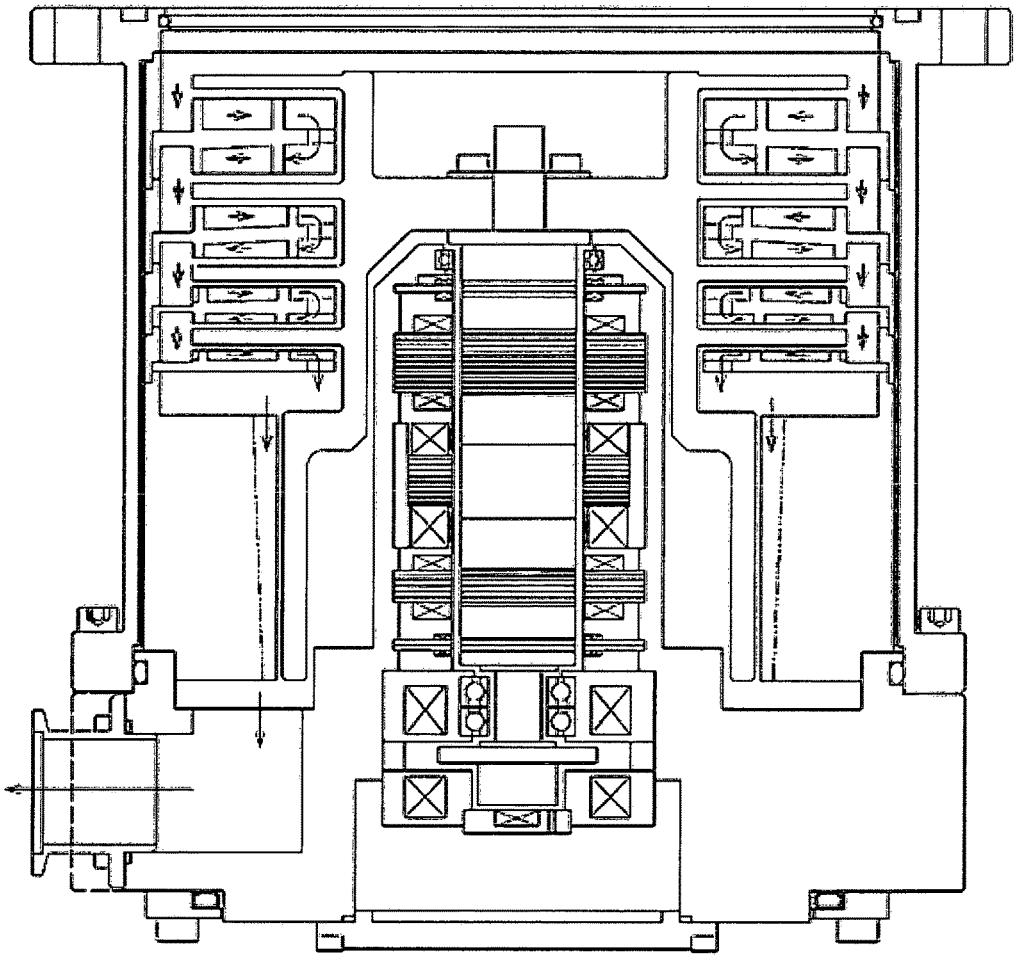
FIG. 14 is a diagram showing a schematic configuration example of a complex pump with a Seigbahn type pump portion and a screw groove type pump portion according to an embodiment.

In the case of the complex type vacuum pump including the screw groove type pump portion, shown in FIG. 14, a screw groove spacer (a stator component) including helical grooves formed on a surface opposed to a rotating cylinder (a rotating component) and facing the outer circumferential surface of the rotating cylinder at a predetermined clearance is further provided. The complex type vacuum pump further includes a gas transfer mechanism in which, when the rotating cylinder rotates at high speed, gas is sent to an outlet port side while being guided by screw grooves (helical grooves) according to the rotation of the rotating cylinder. Note that, in order to reduce force of the gas flowing back to the inlet port side, the clearance is desirably as small as possible.

Figure 15:
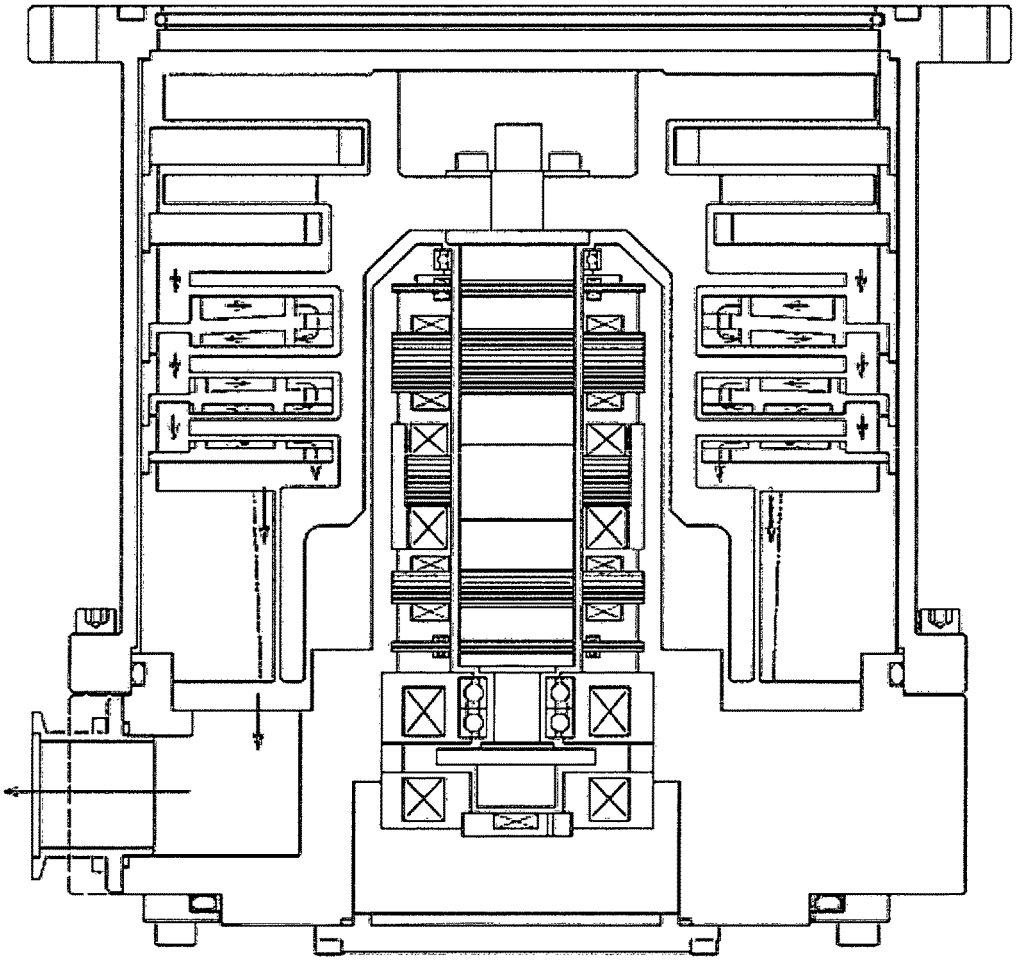
FIG. 15 is a diagram showing a schematic configuration example of a complex pump with a Seigbahn type pump portion, a molecular pump portion and a screw groove type pump portion according to an embodiment.

In the case of the complex type turbo molecular pump including the turbo molecular pump portion and the screw groove type pomp portion, shown in FIG. 15, the turbo molecular pump portion and the screw groove type pump portion are further provided. The complex turbo molecular pump further includes a gas transfer mechanism in which, after being compressed in the turbo molecular pump portion (a second gas transfer mechanism), gas is further compressed in the screw groove type pump portion (a third gas transfer mechanism).

With this configuration, the Seigbahn type molecular pump 1 according to the embodiments and the modifications of the present invention can attain effects explained below with the connection holes provided therein.

A loss in the turning-back region on the rotating cylinder side can be minimized. Therefore, it is possible to construct an efficient Seigbahn type molecular pump.

The space of the turning-back region on the rotating cylinder side, which is conventionally the channel (the region) not having the exhaust action, can be used as an exhaust space by extending the stator disk having the exhaust action. Therefore, space efficiency is high. It is possible to realize a reduction in the sizes of a rotating body and a pump, a reduction in the size of a bearing that supports the rotating body, and energy saving through improvement of efficiency.

The conduits (the channels and the regions) having the exhaust action are connected with each other. Therefore, it is possible to prevent the exhaust action from being interrupted and improve exhaust efficiency.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

What is claimed is:

1. A stator disk that is used in a first gas transfer mechanism for transferring gas from an inlet port side to an outlet port side and forms a spiral groove exhaust portion by interaction with a rotating disk formed in a rotor portion including a rotating cylinder, wherein a spiral groove including root portions and ridge portions is formed in at least a part of opposed surfaces of the stator disk and the rotating disk, a plurality of connection channels extending radially outward from an inner diameter surface of the stator disk or a plurality of through-holes penetrating from the inlet port side to the outlet port side and formed in the root portions of the stator disk is provided in an inner circumference side portion of the stator disk.

2. The stator disk according to claim 1, wherein the plurality of through-holes connect, among the root portions, the root portions formed on a surface of the stator disk on the inlet port side with the root portions formed on a surface of the stator disk on the outlet port side.

3. The stator disk according to claim 2, wherein the plurality of connection channels are formed in, among the root portions, the root portions of either a surface of the stator disk on the inlet port side or a surface of the stator disk on the outlet port side.

4. The stator disk according to claim 2, wherein the plurality of through-holes are formed across, among the root portions, a plurality of the root portions at an end of downstream side on a surface of the inlet port side of the stator disk, or a plurality of the root portions at an end of upstream side on a surface of the outlet port side of the stator disk.

5. The stator disk according to claim 1, wherein the plurality of connection channels are formed in, among the root portions, the root portions of either a surface of the stator disk on the inlet port side or a surface of the stator disk on the outlet port side.

6. The stator disk according to claim 1, wherein the plurality of through-holes are formed across, among the root portions, a plurality of the root portions at an end of downstream side on a surface of the inlet port side of the stator disk, or a plurality of the root portions at an end of upstream side on a surface of the outlet port side of the stator disk.

7. The stator disk according to claim 1, wherein the plurality of connection channels are formed to open to a gap formed by the rotating cylinder and an inner circumferential portion of the stator disk.

8. The stator disk according to claim 1, wherein the plurality of through-holes penetrate from a region on a rotating direction side of the rotating disk in the root portions at an end of downstream side on a surface of the inlet port side of the stator disk, to a region on the opposite side to the rotating direction side of the rotating disk in the root portions at an end of upstream side on a surface of the outlet port side of the stator disk.

9. The stator disk according to claim 1, wherein the spiral groove has a tangential angle larger on an inner diameter side than on an outer diameter side.

10. The stator disk according to claim 1, wherein the spiral groove has a width of the ridge portions smaller on an inner diameter side than on an outer diameter side.

11. A vacuum pump comprising:

a casing in which an inlet port and an outlet port are formed;

a rotating shaft included in the casing and rotatably supported;

the stator disk according to claim 1;

the rotating disk provided in plurality in multiple stages on the rotating shaft; and the first gas transfer mechanism, which is a Seigbahn type molecular pump portion that transfers gas sucked from the inlet port side to the outlet port side by interaction of the rotating disk and the stator disk.

12. The vacuum pump according to claim 11, wherein the vacuum pump is a complex type turbo molecular pump further comprising:

a rotor blade;

a stator blade; and a second gas transfer mechanism, which is a turbo molecular pump portion that transfers gas sucked from the inlet port side to the outlet port side by interaction of the rotor blade and the stator blade.

13. The vacuum pump according to claim 12, wherein the vacuum pump is a complex type turbo molecular pump including a third gas transfer mechanism, which is a screw groove type pump portion that includes a screw groove in at least a part of opposed surfaces of a rotating component and a stator component, and that transfers gas sucked from the inlet port side to the outlet port side.

14. The vacuum pump according to claim 11, wherein a width of at least a portion of a gap formed by the rotating cylinder and the stator disk is smaller than a depth of an exhaust groove channel formed by the stator disk and the rotating disk on the inlet port side.

15. The vacuum pump according to claim 14, wherein the vacuum pump is a complex type turbo molecular pump further comprising:

a rotor blade;

a stator blade; and a second gas transfer mechanism, which is a turbo molecular pump portion that transfers gas sucked from the inlet port side to the outlet port side by interaction of the rotor blade and the stator blade.

16. The vacuum pump according to claim 14, wherein the vacuum pump is a complex type turbo molecular pump including a third gas transfer mechanism, which is a screw groove type pump portion that includes a screw groove in at least a part of opposed surfaces of a rotating component and a stator component, and that transfers gas sucked from the inlet port side to the outlet port side.

17. The vacuum pump according to claim 11, wherein a cross-sectional area of at least a portion of a gap formed by the rotating cylinder and the stator disk is smaller than a cross-sectional area of an exhaust groove channel formed by the stator disk and the rotating disk on the inlet port side.

18. The vacuum pump according to claim 17, wherein the vacuum pump is a complex type turbo molecular pump further comprising:

a rotor blade;

a stator blade; and a second gas transfer mechanism, which is a turbo molecular pump portion that transfers gas sucked from the inlet port side to the outlet port side by interaction of the rotor blade and the stator blade.

19. The vacuum pump according to claim 17, wherein the vacuum pump is a complex type turbo molecular pump including a third gas transfer mechanism, which is a screw groove type pump portion that includes a screw groove in at least a part of opposed surfaces of a rotating component and a stator component, and that transfers gas sucked from the inlet port side to the outlet port side.

20. The vacuum pump according to claim 11, wherein the vacuum pump is a complex type turbo molecular pump including a third gas transfer mechanism, which is a screw groove type pump portion that includes a screw groove in at least a part of opposed surfaces of a rotating component and a stator component, and that transfers gas sucked from the inlet port side to the outlet port side.

* * * * *